US008731425B2

(12) United States Patent
Hiramatsu et al.

(10) Patent No.: US 8,731,425 B2
(45) Date of Patent: May 20, 2014

(54) BIAS APPLICATION CONTROL IN AN IMAGE FORMING APPARATUS

(75) Inventors: Hiroshige Hiramatsu, Inuyama (JP); Hirotaka Mori, Nagoya (JP); Mayu Okada, Tsushima (JP); Masato Makino, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 209 days.

(21) Appl. No.: 13/207,684

(22) Filed: Aug. 11, 2011

(65) Prior Publication Data

US 2012/0039623 A1 Feb. 16, 2012

(30) Foreign Application Priority Data

Aug. 11, 2010 (JP) ..... 2010-180317
Nov. 12, 2010 (JP) ..... 2010-253591

(51) Int. Cl.
*G03G 21/06* (2006.01)

(52) U.S. Cl.
USPC ..... 399/71; 399/96

(58) Field of Classification Search
USPC ..... 399/71, 98
See application file for complete search history.

(56) References Cited

U.S. PATENT DOCUMENTS 4,887,101 A 12/1989 Hirose et al.
6,643,484 B2 * 11/2003 Kojima et al. ..... 399/236
6,766,120 B2 * 7/2004 Yokoi ..... 399/21
6,999,694 B2 * 2/2006 Takami ..... 399/71
8,259,353 B2 9/2012 Hamaya et al.
2008/0317506 A1 12/2008 Furukawa
2009/0016761 A1 * 1/2009 Chiba et al. ..... 399/71
2009/0262374 A1 10/2009 Hamaya et al.

FOREIGN PATENT DOCUMENTS

JP 01-262576 10/1989
JP 03-021972 1/1991
JP 07-168454 7/1995
JP 10-020684 1/1998
JP 10-026918 1/1998
JP 11-052808 2/1999
JP 11-084916 3/1999
JP 2000-039826 2/2000
JP 2005-037665 2/2005

(Continued)

OTHER PUBLICATIONS

Decision of Patent Grant for corresponding Japanese Patent Application No. 2010-180317 dtd. Jul. 31, 2012.

(Continued)

*Primary Examiner* — Walter L Lindsay, Jr.
*Assistant Examiner* — Philip Marcus T Fadul
(74) *Attorney, Agent, or Firm* — Banner & Witcoff, Ltd.

(57) ABSTRACT

An image forming apparatus is provided. The image forming apparatus includes an image carrier, a conveyance belt which conveys a recording sheet via a position opposing the image carrier, a belt cleaner which removes adhered matters on the conveyance belt, a driving unit which drives the image carrier and the conveyance belt, a bias applying unit which applies a cleaning bias to the belt cleaner, and a controller which controls the driving unit and the bias applying unit such that when the image carrier is driven at a first speed, the cleaning bias is applied to the belt cleaner, and when the image carrier is driven at a second speed slower than the first speed, the cleaning bias is not applied to the belt cleaner.

3 Claims, 9 Drawing Sheets

(56) References Cited

FOREIGN PATENT DOCUMENTS

| | | | |
|---|---|---|---|
| JP | 2005-189687 | | 7/2005 |
| JP | 2007-233276 | | 9/2007 |
| JP | 2008-089737 | A | 4/2008 |
| JP | 2009-003377 | | 1/2009 |
| JP | 2009-265170 | A | 11/2009 |
| JP | 2010-160364 | A | 7/2010 |
| JP | 2010-204542 | A | 9/2010 |

OTHER PUBLICATIONS

Decision to Grant issued in corresponding Japanese Patent Application 2010-253591 dated Feb. 5, 2013.

* cited by examiner

FIG. 5

| HUMIDITY [%RH] | | CLEANING CURRENT [ μA ] | |
|---|---|---|---|
| | | BEFORE BASE TIME ELAPSES | AFTER BASE TIME ELAPSES |
| 0 OR GREAT | SMALLER THAN 20 | 35 | 15 |
| 20 | 25 | 35 | 15 |
| 25 | 30 | 35 | 20 |
| 30 | 35 | 35 | 20 |
| 35 | 40 | 35 | 25 |
| 40 | 45 | 35 | 25 |
| 45 | 50 | 35 | 30 |
| 50 | 55 | 35 | 35 |
| 55 | 60 | 35 | 35 |
| 60 | 65 | 35 | 35 |
| 65 | 70 | 35 | 35 |
| 70 | 75 | 35 | 35 |
| 75 | 80 | 35 | 35 |
| 80 | 100 OR SMALLER | 35 | 35 |

| TOTAL NUMBER OF PRINTING SHEETS CORRESPONDING TO THE NUMBER OF PRINTING DOTS IN A PREVIOUS PRINTING OPERATION | NUMBER OF CONTINUOUS PRINTING SHEETS CORRESPONDING TO BASE TIME IN A NEXT PRINTING OPERATION |
|---|---|
| 1 ~ 50 | 10 |
| 51 ~ 100 | 15 |
| 101 ~ | 20 |

BIAS APPLICATION CONTROL IN AN IMAGE FORMING APPARATUS

CROSS-REFERENCE TO RELATED APPLICATION

This application claims priority from Japanese Patent Application No. 2010-180317, filed on Aug. 11, 2010 and No. 2010-253591, filed on Nov. 12, 2010, the entire subject matter of which is incorporated herein by reference.

TECHNICAL FIELD

Aspects of the present invention relate to an image forming apparatus having a conveyance belt to convey a recording sheet thereon.

BACKGROUND

It has been know a so-called tandem-type image forming apparatus in which photosensitive members corresponding to respective colors of yellow, magenta, cyan and black are provided in parallel. In the tandem-type image forming apparatus, developer images are formed on the respective photosensitive members substantially at the same time. In an image forming apparatus adopting a direct transfer system, a conveyance belt is provided to contact each photosensitive member and developer images on the respective photosensitive members are transferred on a recording sheet while being color-overlapped, which is conveyed by the conveyance belt. As a result, a color image is formed on the recording sheet.

For example, JP-A-2009-3377 describes an image forming apparatus configured such that developer remaining on the photosensitive members is temporarily, accumulated on rollers contacting surfaces of the photosensitive members, respectively, and the developer accumulated on the rollers is discharged to the conveyance belt through the photosensitive members after a printing operation is completed, and the like. Accordingly, the image forming apparatus is provided with a cleaning unit to remove developer from the conveyance belt.

The cleaning unit has a primary cleaning roller that contacts the conveyance belt and a secondary cleaning roller that contacts the primary roller, for example. The primary and secondary cleaning rollers are respectively applied with a predetermined cleaning bias. A potential difference between the conveyance belt and the primary cleaning roller and a potential difference between the primary cleaning roller and the secondary cleaning roller transfer the developer on the conveyance belt to the primary cleaning roller and the secondary cleaning roller in corresponding order. Thereby, the developer is removed from the conveyance belt.

In addition to the developer, sheet powders originating from a recording sheet are adhered on the conveyance belt. The adhesion of sheet powders to the conveyance belt is caused during the conveyance of the recording sheet. Accordingly, in order to exclude an influence of the sheet powders on a quality of an image that is formed on the recording sheet, it is necessary to apply the cleaning bias to the primary and secondary cleaning rollers even during an operation for forming an image (image forming operation).

However, from a power consumption point of view, it is not preferable to continuously apply the cleaning bias to the primary and secondary cleaning rollers not only during the cleaning mode after the completion of formation of the image on the recording sheet and but also during the image forming operation.

In addition, in the image forming apparatus, the same bias is applied to the cleaning unit irrespective of operation modes. Accordingly, when the printing operation is continuously performed, in particular, frictional force is increased between the primary cleaning roller and the conveyance belt, so that abnormal noise may be generated. This is caused because the developer serving as lubricant between the primary cleaning roller and the conveyance belt is collected from the primary cleaning roller to the secondary cleaning roller and is thus reduced gradually.

SUMMARY

The present invention has been made in view of the above circumstances. An aspect of the present invention is to provide an image forming apparatus capable of reducing power consumption while excluding an influence of adhered matters, which are adhered on a conveyance belt, on a quality of an image.

Another aspect of the present invention is to provide an image forming apparatus capable of suppressing abnormal noise from being generated when continuously performing a printing operation.

According to an illustrative embodiment of the resent invention, there is provided an image forming apparatus comprising: an image carrier configured to carry a developer image; a conveyance belt configured to convey a recording sheet via a position opposing the image carrier; a belt cleaner configured to remove adhered matters adhered on the conveyance belt; a driving unit configured to drive the image carrier and the conveyance belt; a bias applying unit configured to apply a cleaning bias to the belt cleaner, and a controller configure to control the driving unit and the bias applying unit such that when the image carrier is driven at a first speed and the conveyance belt is driven at a speed corresponding to the first speed, the cleaning bias is applied to the belt cleaner, and when the image carrier is driven at a second speed slower than the first speed and the conveyance belt is driven at a speed corresponding to the second speed, the cleaning bias is not applied to the belt cleaner.

According to the above configuration, it is possible to reduce the power consumption while excluding an influence of adhered matters, which are adhered on the conveyance belt, on a quality of an image.

According to another illustrative embodiment, there is provided an image forming apparatus comprising: an image carrier configured to carry a developer image; a conveyance belt configured to convey a recording sheet via a position opposing the image carrier; a cleaning roller configured to contact the conveyance belt to remove adhered matters adhered on the conveyance belt; a collecting member configured to collect adhered matters adhered on the cleaning roller by current flowing between the cleaning roller and the collecting member; and a controller configured to control an amount of the current flowing between the cleaning roller and the collecting member, wherein the controller decreases the current flowing between the cleaning roller and the collecting member when a base time elapses after a printing operation starts, even before the printing operation ends.

According to the above configuration, since the developer can be left to some extent between the conveyance belt and the cleaning member, it is possible to suppress the frictional force from being increased between the cleaning roller and the conveyance belt and to thus suppress abnormal noise from being generated when performing the continuous printing operation.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIG. 5 is a table showing a relation between humidity and cleaning current;

DETAILED DESCRIPTION

Hereinafter, illustrative embodiments of the invention will be specifically described with reference to the drawings.

First Illustrative Embodiment

1-1. Overall Configuration of Color Printer

Figure 1:
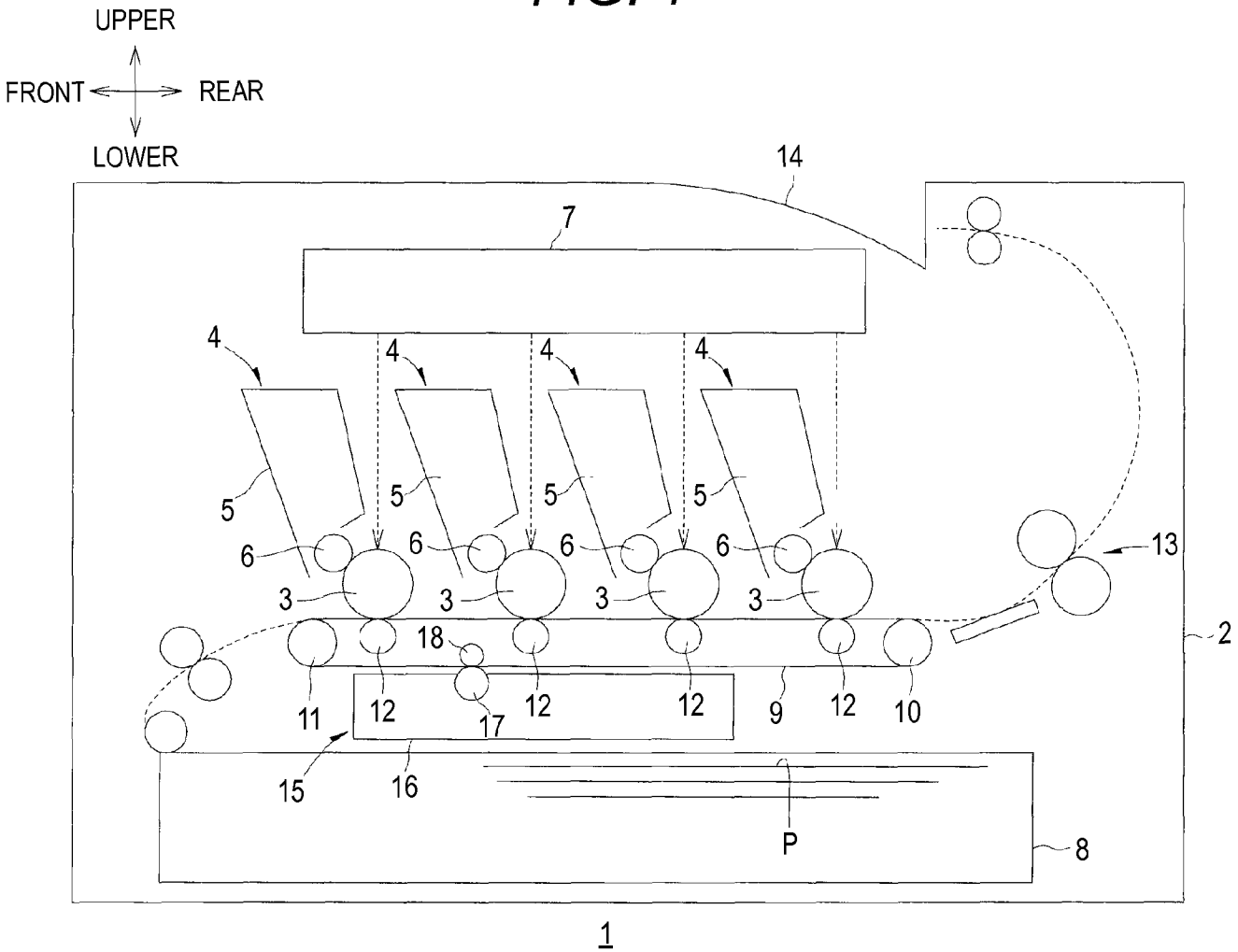
FIG. 1 is a sectional view schematically showing a color printer according to a first illustrative embodiment of the present invention.

As shown in FIG. 1, a color printer 1 that is an example of an image forming apparatus according to a first illustrative embodiment is a tandem-type color laser printer.

In the below descriptions, the directions will be described on the basis of a user who uses the color printer 1. That is, a left side of FIG. 1 is referred to as a 'front side', a right side is referred to as a 'rear side', a front side is referred to as a 'right side' and a backside is referred to as 'left side.' In addition, the upper and lower directions of FIG. 1 are referred to as 'upper and lower sides.'

The color printer 1 has a body casing 2. In the body casing 2, photosensitive drums 3 (examples of four image carriers) are mounted for respective colors of black (K), yellow (Y), magenta (M) and cyan (C). At a central part in the body casing 2, the four photosensitive drums 3 are provided in parallel with each other at an equal distance in a conveyance direction of a recording sheet P by a conveyance belt 9 in order of black, yellow, magenta and cyan from upstream of the conveyance direction.

Developing devices 4 are mounted in correspondence to the respective photosensitive drums 3. The developing device 4 has a housing 5 and a developing roller 6 that is held at a lower end portion of the housing 5. Toner is accommodated in the housing 5. The developing roller 6 is mounted such that it can be rotated about a rotational axis line parallel with a rotational axis line of the photosensitive drum 3. A part of a surface of the developing roller 6 is exposed from the lower end portion of the housing 5 so as to contact a surface of the photosensitive drum 3.

An exposure device 7 that emits laser beams toward the four photosensitive drums 3 is provided at the highest part in the body casing 2.

As the photosensitive drums 3 are rotated, the surfaces of the photosensitive drums 3 are uniformly charged by discharge from a discharger (not shown) and then selectively exposed by the laser beams from the exposure device 7. By the exposure, charges are selectively removed from the surfaces of the photosensitive drums 3, so that electrostatic latent images are formed on the surfaces of the photosensitive drums 3. When the electrostatic latent images are opposing the developing rollers 6, toner is supplied to the electrostatic latent images from the developing rollers 6. Thereby, the toner images are carried on the surfaces of the photosensitive drums 3.

It is noted that four LED arrays may be mounted in correspondence to the respective photosensitive drums 3, instead of the exposure device 7.

A feeder cassette 8 that receives therein the sheets P is provided at the lowest part in the body casing 2.

In addition, the conveyance belt 9 is provided above the feeder cassette 8. The conveyance belt 9 extends between a driving roller 10 and a driven roller 11. The driving roller 10 and the driven roller 11 are provided at an interval in the arrangement direction of the photosensitive drums 3 and are mounted such that they can be respectively rotated about rotational axis lines parallel with the rotational axis lines of the photosensitive drums 3. A part of the conveyance belt 9 (hereinafter, referred to as 'upper part'), which extends between respective upper ends of the driving roller 10 and the driven roller 11, abuts on the surfaces of the four photosensitive drums 3 from the lower sides thereof.

The sheet P that is received in the feeder cassette 8 is conveyed on the conveyance belt 9 by various rollers. The conveyance belt 9 is provided to oppose the four photosensitive drums 3 from the lower sides thereof. Transfer rollers 12 are provided at positions at which the transfer rollers oppose the photosensitive drums 3 with the upper part of the conveyance belt 9 being interposed therebetween. The transfer rollers 12 are mounted such that they can be rotated about rotational axis lines parallel with the rotational axis lines of the photosensitive drums 3. The sheet P that is conveyed on the conveyance belt 9 sequentially passes between the conveyance belt 9 and the respective photosensitive drums 3 as the conveyance belt 9 rotates. Then, the toner images on the surfaces of the photosensitive drums 3 are transferred on the sheet P when the toner images are opposing the sheet P between the photosensitive drums 3 and the transfer rollers 12.

A fixing device 13 is mounted downstream from the conveyance direction of the sheet P regarding the conveyance belt 9. The sheet P on which the toner images are transferred is conveyed to the fixing device 13. In the fixing device 13, the toner images are fixed on the sheet P by heating and pressurization. The sheet P on which the toner images are fixed is discharged to a sheet discharge tray 14 on the upper surface of the body casing 2 by various rollers.

A belt cleaner unit 15 is provided between the feeder cassette 8 and the conveyance belt 9. The belt cleaner unit 15 has a unit case 16 and a cleaning roller 17 (an example of a belt cleaner) that is held at the unit case 16.

The cleaning roller 17 has a rotational axis line that is parallel with the rotational axis lines of the photosensitive drums 3 and is provided to abut on a part of the conveyance belt 9 (hereinafter, referred to as 'lower part'), which extends between respective lower ends of the driving roller 10 and the driven roller 11, from the lower side of the lower part.

A backup roller 18 is provided at a position opposing the cleaning roller 17 while interposing the lower part of the conveyance belt 9 therewith. The backup roller 18 is mounted such that it can be rotated about a rotational axis line parallel with the rotational axis lines of the photosensitive drums 3 and abuts on the lower part of the conveyance belt 9 from the upper side (inner side) thereof.

At the contact part of the conveyance belt 9 and the cleaning roller 17, the cleaning roller 17 is rotated (against-rotated) in the same direction as a rotating direction of the conveyance belt 9 such that the surface of the conveyance belt 9 and the surface of the cleaning roller 17 are rotated in the opposite direction. In addition, the cleaning roller 17 is applied with a predetermined cleaning bias (for example, −1400V), whereas the backup roller 18 is grounded. Thereby, a potential difference is caused between the cleaning roller 17 and the backup roller 18. By the potential difference, the adhered matters such as toner or sheet powders on the conveyance belt 9 are transferred to the cleaning roller 17, so that the adhered matters are removed from the conveyance belt 9.

In the meantime, the unit case 16 includes therein a secondary cleaning roller contacting the cleaning roller 17 and a blade contacting the secondary cleaning roller. The adhered matters transferred to the cleaning roller 17 are transferred from the cleaning roller 17 to the secondary cleaning roller by a potential difference between the cleaning roller 17 and the secondary cleaning roller. The adhered matters transferred to the secondary cleaning roller are scraped and thus separated from the secondary cleaning roller by the blade and are then stored in the unit case 16.

1-2. Electrical Configuration of Color Printer

Figure 2:
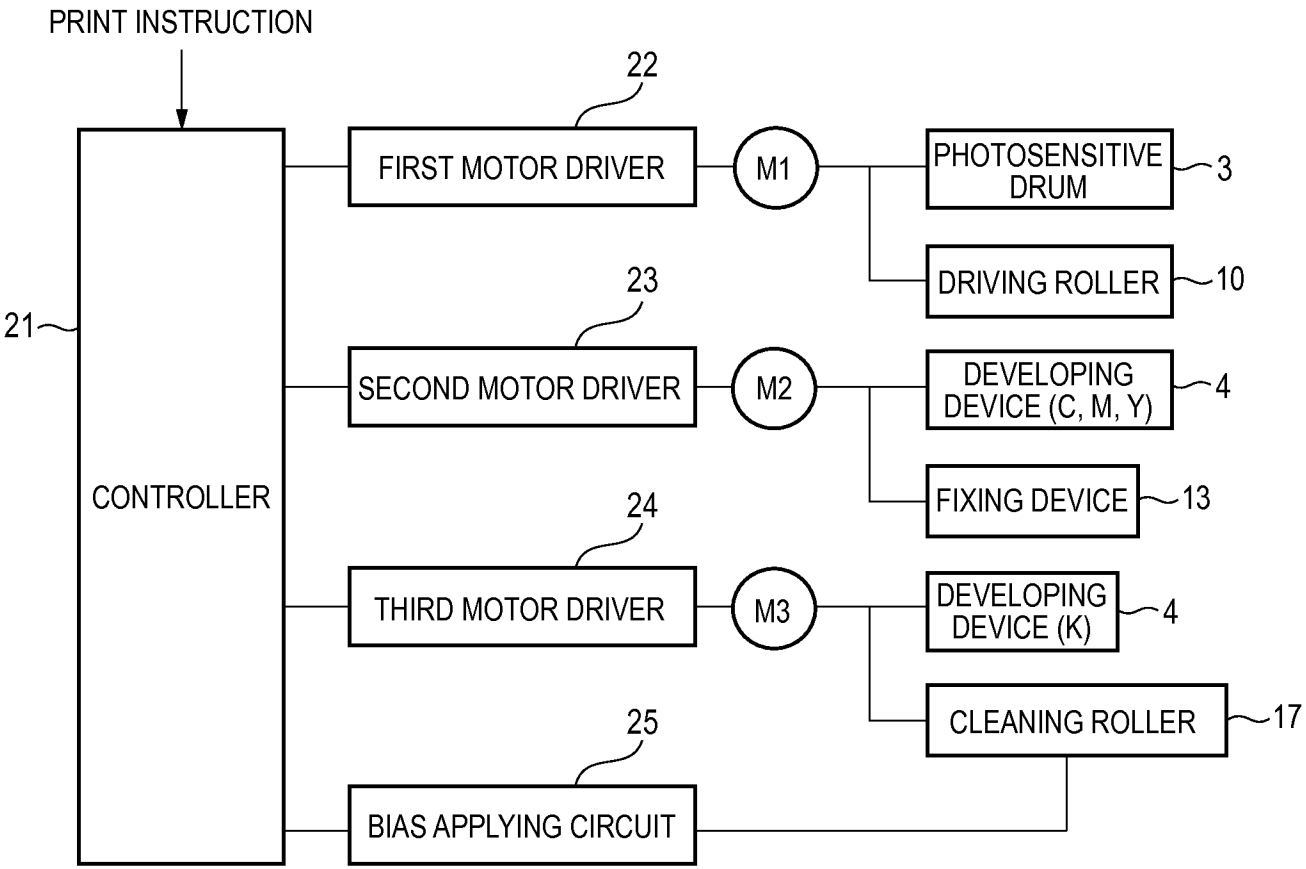
FIG. 2 is a block diagram showing an electrical configuration of the color printer shown in FIG. 1.

As shown in FIG. 2, the color printer 1 has a controller 21 configured to control respective units of the color printer 1. The controller 21 is configured by a microcomputer including a CPU, a RAM, a ROM and the like.

A first motor M1, a second motor M2 and a third motor M3, which are objects to be controlled, are respectively connected to the controller 21 through a first motor driver 22, a second motor driver 23 and a third motor driver 24.

The first motor M1 (an example of a driving unit) is a driving source of the photosensitive drums 3 and the driving roller 10. The driving of the first motor M1 is indirectly controlled by the controller 21 through the first motor driver 22. In other words, an ON/OFF operation of a driving element (for example, FET: Field Effect Transistor) included in the first motor driver 22 is controlled and driving power corresponding to the ON/OFF ratio is supplied to the first motor M1 from the first motor driver 22, so that the driving of the first motor M1 is controlled.

The second motor M2 is a driving source of the developing devices 4 of yellow, magenta and cyan and the fixing device 13. The driving of the second motor M2 is indirectly controlled by the controller 21 through the second motor driver 23. In other words, an ON/OFF operation of a driving element included in the second motor driver 23 is controlled and driving power corresponding to the ON/OFF ratio is supplied to the second motor M2 from the second motor driver 23, so that the driving of the second motor M2 is controlled.

The third motor M3 is a driving source of the developing device 4 of black and the cleaning roller 17. The driving of the third motor M3 is indirectly controlled by the controller 21 through the third motor driver 24. In other words, an ON/OFF operation of a driving element included in the third motor driver 24 is controlled and driving power corresponding to the ON/OFF ratio is supplied to the third motor M3 from the third motor driver 24, so that the driving of the third motor M3 is controlled.

Furthermore, a bias applying circuit 25 (an example of a bias applying unit) which is configured to apply a cleaning bias to the cleaning roller 17 and is an object to be controlled, is connected to the controller 21. The controller 21 controls the bias applying circuit 25, so that a cleaning bias is applied to the cleaning roller 17 from the bias applying circuit 25.

In addition, the controller 21 is connected to a LAN (Local Area Network) and can receive setting information, image data and the like from a personal computer connected to the LAN. When the controller 21 receives the setting information, the image data and the like, the respective units of the color printer 1 are controlled by the controller 21 based on the received data and an image (color image or b/w image) corresponding to the image data is formed on the sheet P.

1-3. Cleaning Bias Control

The color printer 1 has, as operation modes, a full-speed mode (an example of a first image forming mode), a half-speed mode (an example of a second image forming mode) and a cleaning mode.

In the full-speed mode, the photosensitive drums 3 are rotated at a predetermined first speed (for example, 105 rpm). In addition, the developing devices 4 (developing rollers 6), the driving roller 10, the fixing device 13, the cleaning roller 17 and the like are driven at a speed corresponding to the first speed, respectively. As the driving roller 10 is driven at the speed corresponding to the first speed, the conveyance belt 9 rotates (runs) at the speed corresponding to the first speed, that is, at a speed at which the moving speed of the conveyance belt 9 at the parts contacting the photosensitive drums 3 is consistent with circumferential speed of the photosensitive drums 3. Then, the sheet P is conveyed at the speed corresponding to the first speed in the body casing 2 and an image is formed on the sheet P at a first process speed (for example, 28 sheets per minute).

In the half-speed mode, the photosensitive drums 3 are rotated at second speed that is half speed of the first speed. In addition, the developing devices 4 (developing rollers 6), the driving roller 10, the fixing device 13, the cleaning roller 17 and the like are driven at speed corresponding to the second speed, respectively. As the driving roller 10 is driven at the speed corresponding to the second speed, the conveyance belt 9 rotates (runs) at the speed corresponding to the second speed, that is, at a speed that is half speed of the conveyance belt 9 in the full-speed mode. Then, the sheet P is conveyed at the speed corresponding to the second speed in the body casing 2 and an image is formed (output) on the sheet P at a second process speed that is half speed of the first process speed.

In the cleaning mode, the photosensitive drums 3 are rotated at the first speed, the driving roller 10 is driven at the speed corresponding to the first speed and the conveyance belt 9 rotates (runs) at the speed corresponding to the first speed.

In the meantime, the rotating speed of the photosensitive drums 3 is switched into the first speed and the second speed, as the ON/OFF ratio of the driving element included in the first motor driver 22 is changed. Accompanied by this, the rotating speed of the driving roller 10 is switched into the speed corresponding to the first speed and the speed corresponding to the second speed. In addition, the driving speed of the developing devices 4 of yellow, magenta and cyan and the fixing device 13 is switched into the speed corresponding to the first speed and the speed corresponding to the second speed, as the ON/OFF ratio of the driving element included in the second motor driver 23 is changed. Also, the driving speed of the developing device 4 of black and the cleaning roller 17 is switched into the speed corresponding to the first speed and the speed corresponding to the second speed, as the ON/OFF ratio of the driving element included in the third motor driver 24 is changed.

Figure 3:
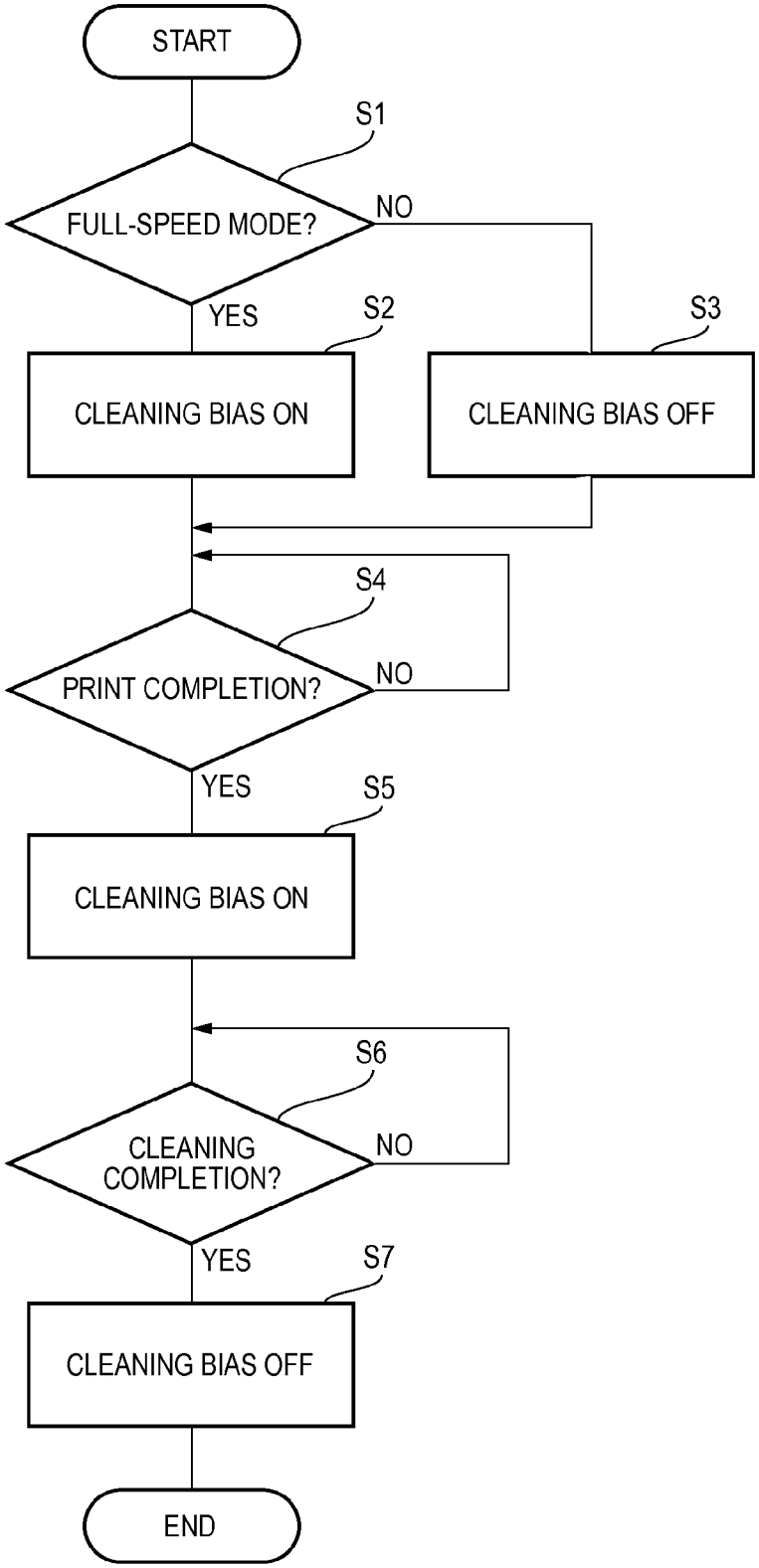
FIG. 3 is a flow chart showing cleaning bias control (cleaning bias determining process) that is executed by a controller shown in FIG. 2.

As shown in FIG. 3, in the color printer 1, the applying of the cleaning bias to the cleaning roller 17 is controlled depending on the operation modes.

Prior to the setting information and the image data, a command to instruct a printing operation is transmitted from the personal computer. When the command is received in the controller 21, an operation for forming (printing) an image on the sheet P in the color printer 1 starts and a process shown in FIG. 3 is performed.

When the controller 21 receives the setting information and the image data following the command, the controller 21 determines whether an operation mode is the full-speed mode or not, based on the setting information (S1). In addition, the image data is developed in a bitmap memory (not shown).

In the color printer 1, it is possible to set a type of the sheet P on which an image is to be output, a resolution (quality) of the image to be output on the sheet P and the like in a setting box that is displayed on a screen (display) of the personal computer having a printer driver for the color printer 1 installed therein. When a user sets the type of the sheet P, the resolution of the image and the like, the setting contents are transmitted to the color printer 1 from the personal computer, as the setting information.

For example, in a case where a normal sheet (copy sheet) is set as the type of the sheet P and the resolution of the image is set normal (for example, 600 dpi), when the setting information is received in the controller 21, the controller 21 determines that an operation mode is the full-speed mode. In addition, in a case where a cardboard is set as the type of the sheet P or the resolution of the image is set fine (for example, 1200 dpi), when the setting information is received in the controller 21, the controller 21 determines that an operation mode is the half-speed mode.

When it is determined that an operation mode is the full-speed mode (S1: YES), the cleaning bias is applied to the cleaning roller 17 from the bias applying circuit 25 (S2). Then, an image is formed on the sheet P at the first process speed in the full-speed mode.

On the other hand, when it is determined that an operation mode is not the full-speed mode, i.e., it is determined that an operation mode is the half-speed mode (S1: NO), the cleaning bias is not applied to the cleaning roller 17 from the bias applying circuit 25. Then, an image is formed on the sheet P at the second process speed in the half-speed mode under a state in which the cleaning bias is not applied to the cleaning roller 17.

When a series of image forming operations (print) are completed in the full-speed mode or half-speed mode (S4: YES), the operation mode is shifted to the cleaning mode. In the cleaning mode, the cleaning bias is applied to the cleaning roller 17 from the bias applying circuit 25 (S5). Thereby, a potential difference between the cleaning roller 17 and the backup roller 18 is generated, so that the adhered matters such as toner or sheet powders on the conveyance belt 9 are transferred to the cleaning roller 17 and are thus removed.

When the operation continues for a predetermined time period in the cleaning mode, it is determined that the cleaning on the conveyance belt 9 is completed (S6: YES) and the applying of the cleaning bias to the cleaning roller 17 from the bias applying circuit 25 is stopped (S7), so that the process shown in FIG. 3 is ended.

1-4. Operational Effects

As described above, in the color printer 1, the sheet P is conveyed via the positions opposing the photosensitive drums 3 by the conveyance belt 9. Accordingly, the toner may be transferred and adhered on the conveyance belt 9 from the photosensitive drums 3 or sheet powders generated from the sheet P may be adhered on the conveyance belt 9. In order to remove the adhered matters such as toner and sheet powders on the conveyance belt 9, the cleaning roller 17 is provided.

The color printer 1 is provided with the controller 21. The controller 21 controls the first motor M1 which drives the photosensitive drums 3 and the conveyance belt 9, and the bias applying circuit 25, which applies the cleaning bias to the cleaning roller 17. When the photosensitive drums 3 are driven at the first speed and the conveyance belt 9 is driven at the speed corresponding to the first speed, the cleaning bias is applied to the cleaning roller 17. In the meantime, when the photosensitive drums 3 are driven at the second speed slower than the first speed and the conveyance belt 9 is driven at the speed corresponding to the second speed, the cleaning bias is not applied to the cleaning roller 17.

When the photosensitive drums 3 are driven at the first speed that is relatively high speed and the conveyance belt 9 is driven at the speed corresponding to the first speed, so that the sheet P is conveyed at the high speed in the apparatus, an amount of the sheet powders generated from the sheet P would be larger and an amount of the sheet powders adhered on the conveyance belt 9 becomes also larger. At this time, since the cleaning bias is applied to the cleaning roller 17, it is possible to favorably remove the adhered sheet powders.

On the other hand, when the photosensitive drums 3 are driven at the second speed that is relatively low speed and the conveyance belt 9 is driven at the speed corresponding to the second speed, so that and the sheet P is conveyed at low speed in the apparatus, an amount of the sheet powders generated from the sheet P would be smaller and an amount of the sheet powders adhered on the conveyance belt 9 becomes also smaller. At this time, since the applying of the cleaning bias to the cleaning roller 17 is stopped, it is possible to reduce the power consumption.

Accordingly, it is possible to reduce the power consumption while excluding an influence of the adhered matters, which are adhered on the conveyance belt 9, on a quality of an image.

The color printer 1 has, as the operation modes, the full-speed mode, the half-speed mode and the cleaning mode. In the full-speed mode, the photosensitive drums 3 are driven at the first speed and the conveyance belt 9 is driven at the speed corresponding to the first speed, so that an image is formed on the sheet P at the first process speed. In addition, the cleaning bias is applied to the cleaning roller 17. In the half-speed mode, the photosensitive drums 3 are driven at the second speed and the conveyance belt 9 is driven at the speed corresponding to the second speed, so that an image is formed on the sheet P at the second process speed. In the cleaning mode, the cleaning bias is applied to the cleaning roller 17 and the matters adhered on the conveyance belt 9 are removed.

The cleaning mode is performed after the full-speed mode and the half-speed mode are completed. Thereby, the adhered matters are removed from the conveyance belt 9 before a next full-speed mode or half-speed mode starts, so that it is possible to keep the conveyance belt 9 clean.

In the cleaning mode, the photosensitive drums 3 are driven at the first speed and the conveyance belt 9 is driven at the speed corresponding to the first speed. Thereby, it is possible to shorten a time period during which the conveyance belt 9 makes a round and also to shorten a time period that is required to remove the adhered matters from the entire periphery of the conveyance belt 9.

1-5. Modified Illustrative Embodiments

While the present invention has been shown and described with reference to certain illustrative embodiments thereof, it will be understood by those skilled in the art that various changes in form and details may be made therein without departing from the spirit and scope of the invention as defined by the appended claims.

For example, the inventive concept of the present invention is not limited to the tandem-type color printer 1 and may be applied to a monochrome printer.

In the above illustrative embodiment, in the half-speed mode, the cleaning bias is not applied to the cleaning roller 17. However, the cleaning bias may be applied to the cleaning roller 17 by an amount smaller than that applied to the cleaning roller 17 in the full-speed mode or the cleaning mode.

Second Illustrative Embodiment

Next, a second illustrative embodiment of the present invention will be specifically described with reference to the drawings. A schematic configuration and a basic operation of a color printer 101 that is an example of an image forming apparatus according to a second illustrative embodiment will be briefly described and then a characteristic configuration and control will be specifically described.

2-1. Overall Configuration of Color Printer

Figure 4:
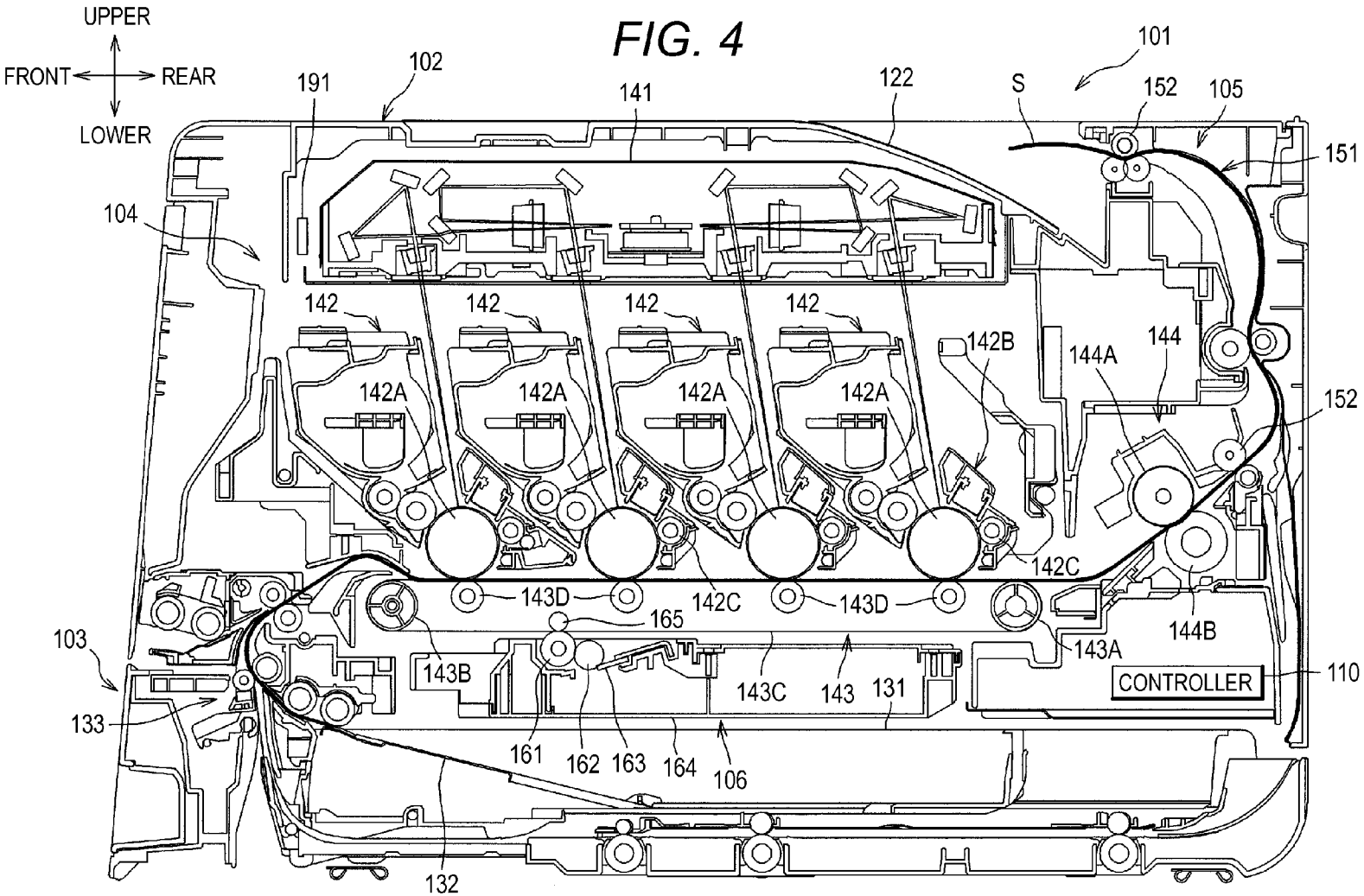
FIG. 4 is a sectional view schematically showing a color printer according to a second illustrative embodiment.

As shown in FIG. 4, the color printer 101 mainly has a feeder part 103 that feeds a recording sheet S, an image forming part 104 that forms an image on the fed sheet S, a sheet discharge part 105 that discharges the sheet S having an image formed thereon and a cleaning part 106 in a body casing 102 (an example of an apparatus body).

The feeder part 103 is provided at a lower part in the body casing 102 and mainly has a feeder cassette 131, a sheet pressing plate 132 and a feeder mechanism 133. The sheet S received in the feeder cassette 131 is upwardly directed by the sheet pressing plate 132 and fed to the image forming unit 104 by the feeder mechanism 133.

The image forming part 104 mainly has an exposure device 141, four developing units 142, a transfer unit 143 and a fixing device 144.

The exposure device 141 is provided at an upper part in the body casing 102 and has a laser light source (not shown), a polygon mirror for which a reference numeral is omitted, a plurality of lenses and a plurality of reflecting mirrors. Laser light, which is emitted from the laser light source based on image data, is reflected on the polygon mirror or reflecting mirrors or passes through the lenses and is then scanned on surfaces of photosensitive drums 142A.

The developing units 142 are provided in a front-rear direction between the feeder cassette 131 and the exposure device 111 and mainly have, respectively, a photosensitive drum 142A (an example of an image carrier), a charger 142B, a holding roller 142C and a developing roller, a supply roller, a layer thickness regulating blade and a toner accommodating part accommodating toner (developer), for which reference numerals are omitted. The respective developing units 112 have the substantially same configuration, except that colors of toner accommodated in the toner accommodating parts are different.

The holding roller 142C is a roller whose roller shaft made of metal is covered with a roller member made of conductive rubber material and the like, and is provided with contacting the photosensitive drum 142A. According to the know control, the holding roller 1420 adsorbs and temporarily holds the toner remaining on the surface of the photosensitive drum 142A when performing a printing operation and is applied with a bias for discharging the held toner to the photosensitive drum 142A when performing a cleaning operation.

The transfer unit 143 is provided between the feeder cassette 131 and the developing units 142 and mainly has an endless conveyance belt 109 that extends between a driving roller 143A and a driven roller 143B and four transfer rollers 143D. The conveyance belt 143C is provided such that an outer surface thereof abuts on the respective photosensitive drums 142A and the conveyance belt 143C is sandwiched between the respective transfer rollers 143D at an inner side thereof and the respective photosensitive drums 142A. Accordingly, the conveyance belt 143C conveys the sheet S via respective positions opposing the photosensitive drums 142A.

The fixing device 144 is provided at a rear side of the developing units 142 and mainly has a heating roller 144A and a pressing roller 144B that opposes the heating roller 144A and presses the heating roller 144A.

The sheet discharge unit 105 mainly has a sheet discharge path 151 for guiding the sheet S delivered from the fixing device 144 and a plurality of conveyance rollers 152 that conveys the sheet S.

2-2. Printing Operation

Next, a printing operation in the color printer 101 will be schematically described.

When an instruction to start a printing operation or a printing job including image data to be printed, information about the number of sheets to be printed and the like is input from an external apparatus such as personal computer (PC), the color printer 101 rotates the photosensitive drums 142A and the conveyance belt 143C.

The surfaces of the photosensitive drums 142A being rotated are uniformly charged by the chargers 142B and then exposed by the laser light emitted from the exposure device 141, so that electrostatic latent images based on the image data are formed on the photosensitive drums 142A.

At this time, the toner in the toner accommodating part is supplied to the developing roller through the supply roller, is introduced between the developing roller and the layer thickness regulating member and is then carried, as a thin layer having a predetermined thickness, on the developing rollers. The toner carried on the developing roller is supplied to the photosensitive drums 142A having the electrostatic latent images formed thereon, so that the electrostatic latent images become visible and toner images (developer images) are formed on the photosensitive drums 142A.

At an appropriate timing during the above process, the feeder mechanism 133 feeds the sheet S received in the feeder cassette 131 to the image forming part 104. In this illustrative embodiment, the time at which the feeder mechanism 133 feeds (picks up) the sheet S (first sheet S) received in the feeder cassette 131 toward the image forming part 104 is referred to as 'printing start' that is a point of time at which a count of a base time (which will be described later) starts.

Then, the sheet S fed from the feeder part 103 is conveyed between the photosensitive drums 142A and the conveyance belt 143C (transfer rollers 143D), so that the toner images formed on the respective photosensitive drums 142A are sequentially transferred on the sheet S with being overlapped. The sheet S having the toner images transferred thereon is conveyed between the heating roller 144A and the pressing roller 144B, so that the toner images are heat-fixed.

The sheet S having the toner images heat-fixed thereon (sheet S having an image formed thereon) is conveyed through the sheet discharge path 151 by the conveyance roller 152 and is discharged to the outside of the body casing 102, so that the sheet is stacked on the sheet discharge tray 122.

2-3. Configuration and Cleaning Operation of Cleaning Part

Next, a configuration and a cleaning operation of the cleaning part 106 are schematically described.

The cleaning part 106 is provided below the conveyance belt 143C and mainly has a cleaning roller 161, a collecting roller 162 (an example of a collecting member), a scraping blade 163, a toner storing part 164 and a backup roller 165 that is provided to sandwich the conveyance belt 143C between the backup roller 165 and the cleaning roller 161.

The cleaning roller 161 is a foamed roller whose roller shaft made of metal is covered with a roller member made of conductive foamed material (for example, urethane and the like), and is provided while contacting the conveyance belt 143C. Current flows between the backup roller 165 and the cleaning roller 161 through the conveyance belt 143C, so that the cleaning roller adheres toner, sheet powders and the like, which are adhered on the conveyance belt 143C, on a surface of the cleaning roller and thus collects (removes) the same.

The collecting roller 162 is a roller (for example metal roller and the like) that is pressed to the cleaning roller 161 and is made of conductive rigid material such as metal. The current flows between the collecting roller and the cleaning roller 161, so that the collecting roller adheres the toner and the like, which are adhered on the cleaning roller 161, on a surface thereof and thus collects the same.

In the meantime, the color printer 101 is configured to apply a bias between the backup roller 165 and the collecting roller 162 at the substantially same timing as the start timing of the rotation driving of the conveyance belt 143C. The bias is a bias with which current moves the toner and like adhered on the conveyance belt 143C to the cleaning roller 161 from the conveyance belt 143C and further to the collecting roller 162 from the cleaning roller 161. The applying of the bias is stopped at the substantially same timing as the stop timing of the driving of the conveyance belt 143C.

The scraping blade 163 is a blade that is pressed to the collecting roller 162, thereby scraping the toner and like adhered on the surface of the collecting roller 162.

The toner storing part 164 is a member having a receptacle shape that stores the toner and the like scraped and dropped by the scraping blade 163.

In the cleaning operation that is executed after the printing operation is completed and the like, the photosensitive drums 142A and the conveyance belt 143C are rotated and the bias is applied between the backup roller 165 and the collecting roller 162. Then, the toner held on the holding roller 142C is discharged to the conveyance belt 143C through the photosensitive drums 142A and is moved with the conveyance belt 143C.

After that, the toner adhered on the conveyance belt 143C is moved between the conveyance belt 143C (backup roller 165) and the cleaning roller 161 by the rotation driving of the conveyance belt 143C and is then collected by the collecting roller 162. The toner collected by the cleaning roller 161 is collected by the collecting roller 162, is scraped and dropped from the collecting roller 162 by the scraping blade 163 and is then stored in the toner storing part 164.

2-4. Control on Cleaning Current During Printing Operation

Next, the characteristic configuration and control (control on the cleaning current during the printing operation) are specifically described.

In this illustrative embodiment, the color printer 101 further has a humidity sensor 191 and a controller 110 in the body casing 102. The humidity sensor 191 is a—known sensor that detects humidity in the body casing 102 and is mounted at an appropriate position in the body casing 102. The humidity that is detected by the humidity sensor 191 is output to the controller 110.

The controller 110 has a CPU, a RAM, a ROM, an input/output interface and the like, which are not shown, and controls operations of the color printer, based on the printing job input from the external apparatus and outputs from various sensors such as humidity sensor 191.

In the this illustrative embodiment, when the printing operation is executed, the controller 110 controls an amount of the bias that is applied between the backup roller 165 and the collecting roller 162, i.e., the current (hereinafter, referred to as cleaning current) that flows among the backup roller 165, the cleaning roller 161 and the collecting roller 162.

Herein, the current between the cleaning roller 161 and the collecting roller 162 when the printing operation is executed is controlled. Accordingly, in the below descriptions, 'between the cleaning roller 161 and the collecting roller 162' is sometimes referred. However, in this illustrative embodiment, the cleaning current is actually applied between the backup roller 165 and the collecting roller 162.

The control by the controller 110 is more specifically described. When the base time elapses after the printing starts (first sheet S is picked up), even before the printing operation ends, the controller 110 causes the cleaning current, which flows between the cleaning roller 61 and the collecting roller 62, to be smaller than the current before the base time elapses.

In this illustrative embodiment, the base time is a time period during which the printing (image forming) operation is continuously performed for the predetermined number of sheets (for example, 10 sheets) after the printing operation starts In the meantime, it is possible to determine whether the printing operation is performed for a tenth sheet S by a known configuration or method such as by determining whether a sheet sensor (not shown) provided on the sheet discharge path 151 detects a passing of the tenth sheet S. Accordingly, the detailed description thereof is omitted in the specification.

The 'printing end' means a point of time at which the printing operation ends. In this illustrative embodiment, the printing end is a point of time at which the processes (printing for the sheets S) of all printing jobs accumulated in the color printer 1 are completed.

The cleaning current that is supplied between the cleaning roller 161 and the collecting roller 162 is determined by a table (refer to FIG. 5), which is preset and stored in the controller 110, based on the humidity detected by the humidity sensor 191. In a humidity item of FIG. 5, each row indicates a left numerical value or greater and smaller than a right numerical value (for example, in seventh row, 45% RH or greater and smaller than 50% RH) and only the lowest row indicates 80% RH or greater and 100% RH or smaller. It is noted that the values of a cleaning current item are exemplary and the present invention is not limited thereto.

Figure 6:
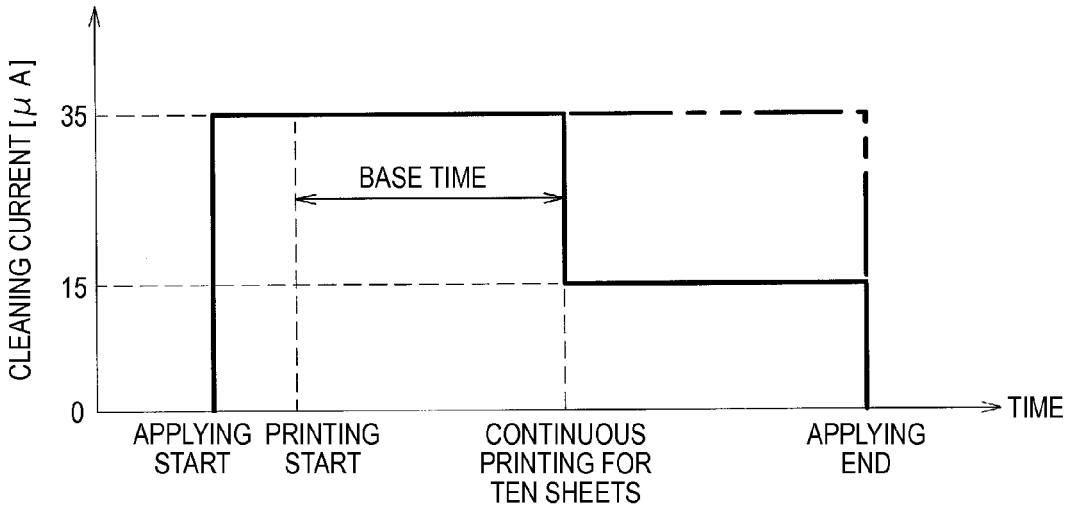
FIG. 6 is a timing chart showing control on cleaning current according to the second illustrative embodiment.

When the humidity in the body casing 102 is 20% RH or greater and smaller than 25% RH at the time at which a printing job is input to the color printer 101, for example, the controller 110 determines, as the cleaning current before the base time elapses, 35 μA based on the table shown in FIG. 5 and applies the cleaning current of 35 μA between the cleaning roller 161 and the collecting roller 162 (printing start), as shown in FIG. 6.

Then, when the base time elapses after the printing operation starts (when the printing operation is continuously performed for the ten sheets S), the controller 110 determines, as the cleaning current after the base time elapses, 15 μA based on the table shown in FIG. 5 and applies the cleaning current of 15 μA between the cleaning roller 161 and the collecting roller 162 (continuous printing for ten sheets), as shown in FIG. 6.

Here, as shown in FIG. 5, when the humidity in the body casing 102 is 50% RH or greater, the controller 110 is configured such that the cleaning current of 35 μA is unchanged before and after the base time elapses. In other words, in this illustrative embodiment, when the humidity in the body casing 2 is below 50% RH (predetermined value or smaller), the controller 110 is configured to cause the cleaning current, which flows between the cleaning roller 161 and the collecting roller 162 when the base time elapses after the printing start, to be smaller the current before the base time elapses.

In addition, as shown in FIG. 5, the cleaning current after the base time elapses is set to be gradually decreased such that when the humidity in the body casing 102 is 45% RH or greater and smaller than 50% RH, the cleaning current is 30 μA, when the humidity is 35% RH or greater and smaller than 15% RH, the cleaning current is 25 μA, when the humidity is 25% RH or greater and smaller than 35% RH, the cleaning current is 20 μA and when the humidity is 0% RH or greater and smaller than 25% RH, the cleaning current is 15 μA. In other words, in this illustrative embodiment, when the humidity in the body casing 102 is low, the controller 110 is configured to cause the cleaning current flowing between the cleaning roller 161 and the collecting roller 162 to be smaller, compared to a case where the humidity in the body casing 102 is high.

The series of control on the cleaning current at the time of the printing operation is more specifically described with reference to FIG. 7.

Figure 7:
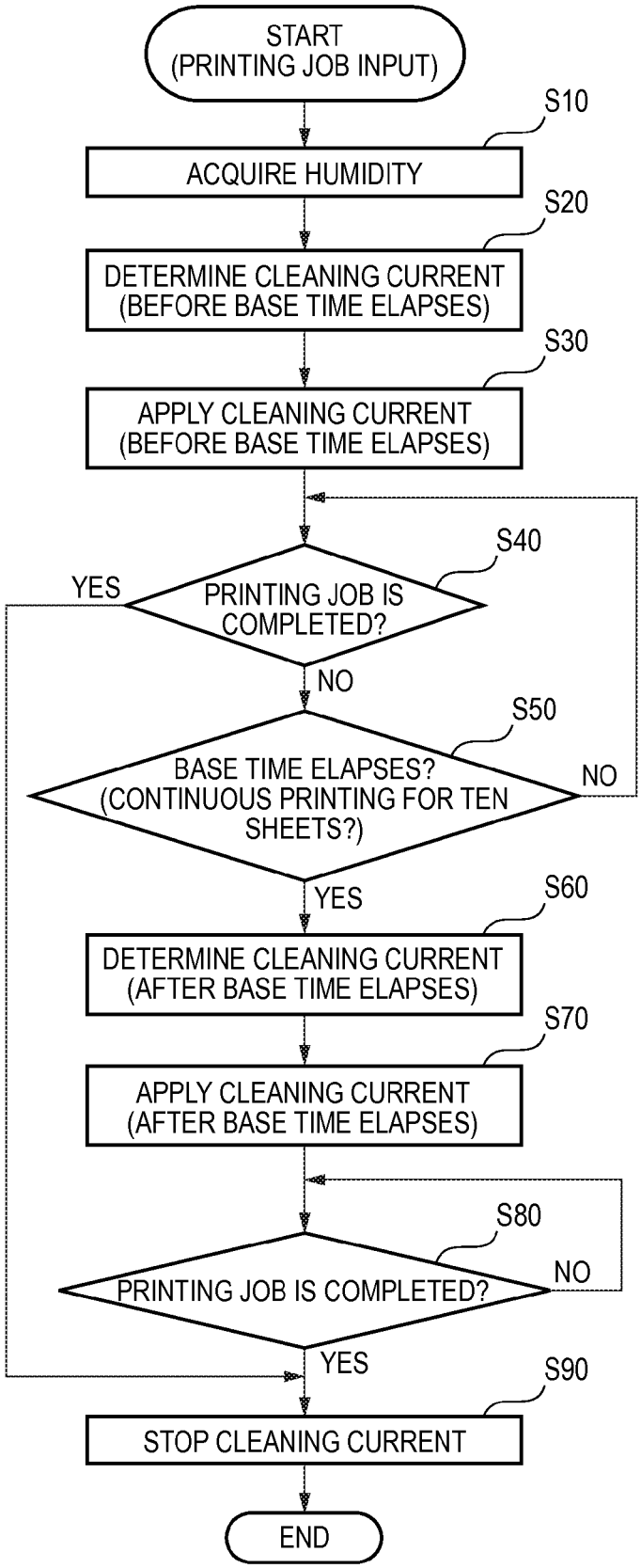
FIG. 7 is a flow chart showing control on cleaning current when performing a printing operation according to the second illustrative embodiment.

As shown in FIG. 7, when a printing job is input (starts), the controller 110 acquires an output value (humidity in the body casing 102) of the humidity sensor 191 (S10). Then, the controller 110 determines the cleaning current before the base time elapses based on the table shown in FIG. 5, according to the acquired humidity (S20) and applies the determined cleaning current (35 μA, for example) between the cleaning roller 161 and the collecting roller 162 (S30, printing start in FIG. 6).

Then, the controller 110 starts a printing operation (picks up a first sheet S) (printing start in FIG. 6). Then, the controller 110 determines whether the printing job is completed (whether all sheets are processed) at the appropriate timing (S40). When the printing job is completed (S40, Yes), for example such as a case where the printing number included in the printing job is one sheet, the controller 110 stops applying the cleaning current (35 μA) (S90) and completes (finishes) the process.

On the other hand, when the printing job is not completed (S40, No), the controller 110 determines whether the base time elapses after the printing start, i.e., whether the printing operation is continuously performed for the ten sheets S after the printing operation starts (S50). When the base time has not elapsed after the printing start (S50, No), the controller 110 returns to the step of S40.

When the base time elapses after the printing start (S50, Yes), the controller 110 determines the cleaning current after the base time elapses based on the table shown in FIG. 5, according to the humidity acquired in the step of S10 (S60).

Here, when the humidity is 50% RH or greater, the value of the cleaning current after the base time elapses is determined 35 μA based on the table shown in FIG. 5. After that, the controller 110 applies the determined cleaning current (35 μA) between the cleaning roller 161 and the collecting roller 162 (S70). In this case, since the determined value of the cleaning current is not changed before and after the base time elapses, the cleaning current is continuously applied in the actual control (refer to dashed-two dotted line in FIG. 6).

On the other hand, when the humidity is below 50% for example 20% RH or greater and smaller than 25% RH, the value of the cleaning current after the base time elapses is determined 15 μA (S60). After that, the controller 110 applies the determined cleaning current (15 μA) between the cleaning roller 161 and the collecting roller 162 (S70). Thereby, the controller 110 changes the cleaning current flowing between the cleaning roller 161 and the collecting roller 162 into the smaller value (15 μA) (continuous printing for ten sheets in FIG. 6).

Then, the controller 110 determines whether the printing job is completed at the appropriate timing (S80). When the printing job is not completed (S80, No), the controller 110 repeats the step of S80 until the printing job is completed. When the printing job is completed (S80, Yes), the controller 110 stops applying the cleaning current (S90, applying end in FIG. 6) and completes (finishes) the process.

2-5. Operational Effects

According to the second illustrative embodiment, following effects can be obtained.

When the base time elapses after the printing operation starts, even before the printing operation ends, the cleaning current flowing between the cleaning roller 161 and the collecting roller 162 is decreased. Accordingly, it is possible to reduce the amount of toner that is collected from the cleaning roller 161 to the collecting roller 162. Thereby, since the toner serving as lubricant can be left to some extent between the conveyance belt 143C and the cleaning roller 161, it is possible to suppress the frictional force from being increased between the cleaning roller 161 and the conveyance belt 143C and to thus suppress abnormal noise from being generated when continuously performing the printing operation.

In the meantime, even when the toner, which is left between the conveyance belt 143C and the cleaning roller 161 by reducing the cleaning current, is conveyed between the photosensitive drums 142A by the conveyance belt 143C, an amount of the toner is too small to appear on a backside of the sheet S as blots.

In this illustrative embodiment, when the humidity in the body casing 102 is the predetermined value or smaller (below 50% RH), the cleaning current is reduced. Accordingly, it is possible to suppress the abnormal noise from being generated when continuously performing the printing operation, further surely, under environment in which the toner is apt to move from the conveyance belt 143C to the collecting roller 162 through the cleaning roller 161.

In this illustrative embodiment, when the humidity in the body casing 102 is below 50% RH, the cleaning current is made smaller in the lower humidity than in the higher humidity. Accordingly, it is possible to suppress the abnormal noise from being generated when continuously performing the printing operation, further surely.

In this illustrative embodiment, the time period during which the printing operation is continuously performed for the predetermined number of sheets (10 sheets) after the printing start is adopted as the base time. However, the present invention is not limited thereto. For example, the base time may be until predetermined time elapses (for example, 20 seconds) after the printing start, for example.

Third Illustrative Embodiment

Next, a third illustrative embodiment of the present invention will be described. In the below the same constitutional elements as those described in the second illustrative embodiment are indicated with the same reference numerals and the descriptions thereof are omitted.

In the second illustrative embodiment, an example where the base time (until the printing is continuously performed for the predetermined number of sheets S after the printing operation starts) is substantially constant, i.e., an example where the controller 110 does not change the base time has been described. In this third illustrative embodiment, the controller 110 changes the base time according to a predetermined parameter (for example, humidity in the body casing 2).

Figures 8, 9:
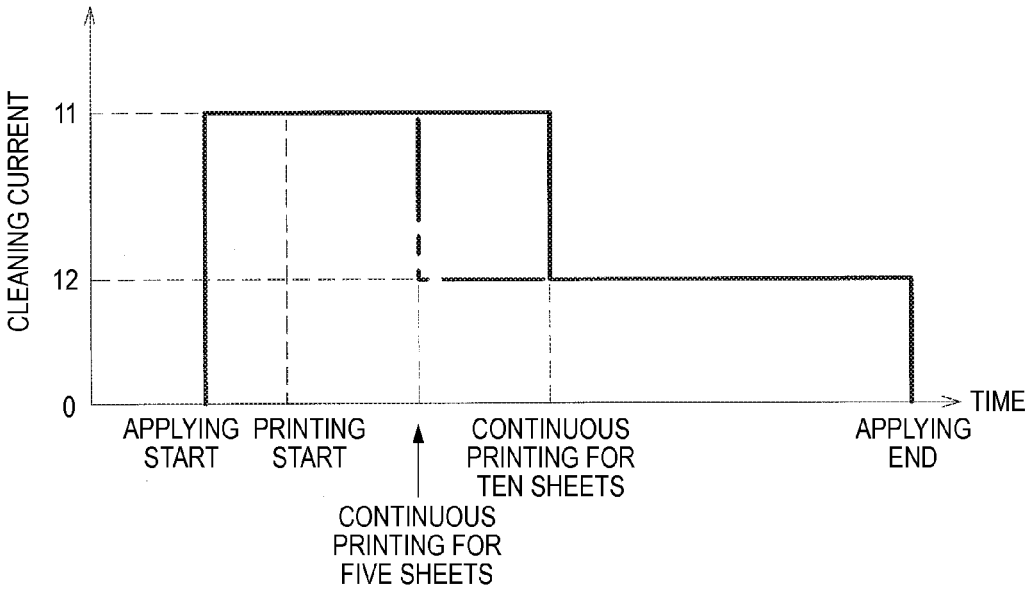
FIG. 8 is a timing chart showing control on cleaning current according to a third illustrative embodiment.
FIG. 9 is a table showing a relation between the number of printing dots included in a printing job, which is input when performing a previous printing operation, and a base time after a next printing operation starts according to a fourth illustrative embodiment.

As shown in FIG. 8, when a printing job is input, the controller 110 of this illustrative embodiment applies cleaning current I1 between the backup roller 165 and the collecting roller 162 (applying start). Then, when the base time elapses after the printing start (continuous printing for five or ten sheets), the controller 110 changes the cleaning current I1 to cleaning current I2 smaller than the cleaning current I1 and applies the same between the backup roller 165 and the collecting roller 162.

In this illustrative embodiment, when the humidity in the body casing 102 is a preset threshold value or greater, the controller 110 sets the base time to be a time period during which the printing operation is continuously performed for ten sheets S after the printing start. When the humidity in the body casing 102 is smaller than the preset threshold value, the controller 110 sets the base time to be a time period during which the printing operation is continuously performed for five sheets S after the printing start. That is, in this illustrative embodiment, when the humidity in the body casing 102 is low, the controller 110 is configured to set the base time shorter, compared to a case when the humidity is high.

Accordingly, as shown in FIG. 8, under environments in which the humidity is high (threshold value or greater), the controller 110 decreases the cleaning current for the time period during which the printing operation is continuously performed for ten sheets S (continuous printing for ten sheets) after the printing start. In addition, under environments in which the humidity is low (below the threshold value), the controller 110 decreases the cleaning current smaller for the time period during which the printing operation is continuously performed for five sheets S (continuous printing for five sheets) after the printing start.

According to the above configuration, under the low humidity environment in which the toner is apt to move from the conveyance belt 143C to the collecting roller 162 through the cleaning roller 161, the cleaning current can be rapidly decreased. Therefore, it is possible to prevent the toner between the conveyance belt 143C and the cleaning roller 161 from being excessively reduced. As a result, it is possible to securely suppress the abnormal noise from being generated when continuously performing the printing operation, depending on the humidity.

It is noted that the specific number of continuous printing sheets (base time) such as ten sheets and five sheets is exemplary and the present invention is not limited thereto. In addition, the base time is not limited to the time period during which the printing operation is continuously performed for the predetermined number of sheets S after the printing start. For example, the base time may be until predetermined time elapses after the printing operation starts. Furthermore, a plurality of 'threshold values' of the humidity may be set.

Fourth Illustrative Embodiment

Next, a fourth illustrative embodiment of the present invention will be described. Also in this illustrative embodiment, the controller 110 changes the base time.

The color printer 101 of this illustrative embodiment is configured to execute the cleaning operation after the printing is completed (after the processes of all printing jobs are completed).

In this configuration, when the number of printing dots (total number of printing dots) of the image data, which is included in the printing jobs (all printing jobs) that are input in a previous printing operation, is small, that is, when an amount of toner used in the previous printing operation is small, an amount of the toner that is discharged to the conveyance belt 143C during the cleaning operation is small. Then, an amount of the toner that remains on the conveyance belt 143C after the cleaning operation is also small. Therefore, if the base time is too long in a next printing operation, the toner between the conveyance belt 143C and the cleaning roller 161 may be excessively reduced before decreasing the cleaning current.

Accordingly, in this illustrative embodiment, the amount of toner used in the previous printing operation is recognized with the total number of printing sheets S printed in the previous printing operation and the controller 110 changes the base time after a next printing start, depending on the total number of printing sheets.

Specifically, the controller 110 stores a preset table (in which the numerical values are exemplary) as shown in FIG. 9. When the total number of printing sheets is large in a previous printing operation, the controller 110 causes the continuous number of printing sheets to be large from a printing start in a next printing operation, thereby extending the base time. When the total number of printing sheets is small in a previous printing operation, the controller causes the continuous number of printing sheets to be small from a printing start in a next printing operation, thereby shortening the base time.

According this illustrative embodiment, when the number of printing dots included in the printing job, which is input in a previous printing operation, is small, the controller 110 shortens the base time in a next printing operation, compared to a case where when the number of printing dots included in the input printing job is large.

According to this illustrative embodiment, since the toner between the conveyance belt 143C and the cleaning roller 161 is not excessively reduced before the cleaning current is decreased, it is possible to leave an appropriate amount of toner between the conveyance belt 143C and the cleaning roller 161 after decreasing the cleaning current. As a result, it is possible to suppress the abnormal noise from being generated when continuously performing the printing operation, further surely.

In the table shown in FIG. 9, the total number of printing sheets is divided with two threshold values (50 sheets and 100 sheets). However, the present invention is not limited thereto. For example, the threshold value may be one or three or more.

In this illustrative embodiment, the amount of toner used in the previous printing operation (number of printing dots of the image data included in the printing job that is input in the previous printing operation) is recognized with the total number of printing sheets S printed in the previous printing operation. However, the present invention is not limited thereto. For example, it may be possible to actually count the number of printing dots in accordance with a known configuration or method and to perform the control based on the information of the count value.

While the present invention has been shown and described with reference to certain illustrative embodiments thereof, it will be understood by those skilled in the art that various changes in form and details may be made therein without departing from the spirit and scope of the invention as defined by the appended claims.

Figure 10A:
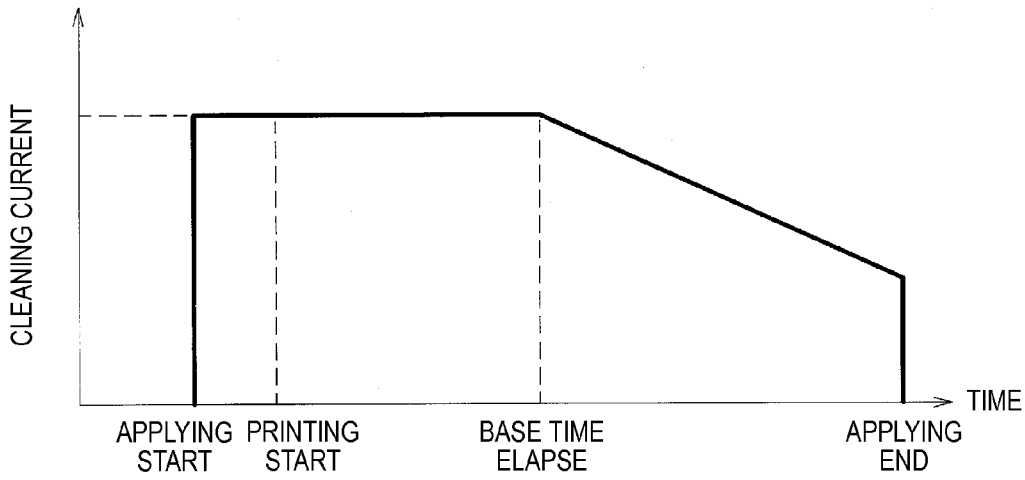
FIGS. 10A and 10B are timing charts showing control on cleaning current according to a modified illustrative embodiment.
Figure 10B:
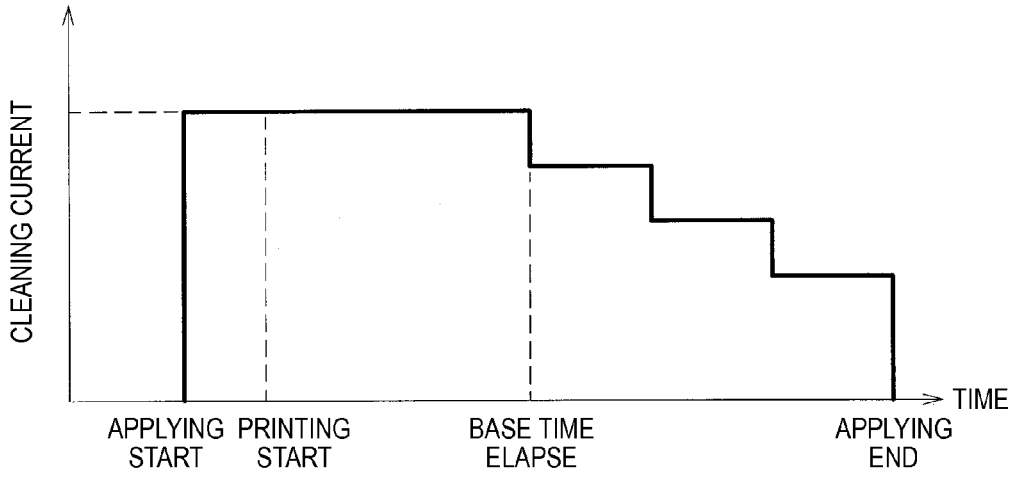

In the above illustrative embodiments, the controller 110 decreases the cleaning current flowing between the cleaning roller 161 and the collecting roller 162 (collecting member) when the base time elapses and fixes the cleaning current thereafter. However, the present invention is not limited thereto. For example, as shown in FIG. 10A, the controller may control such that the cleaning current flowing between the cleaning roller and the collecting roller is continuously decreased after the base time elapses. In addition, as shown in FIG. 10B, the controller may control such that the cleaning current flowing between the cleaning roller 161 and the collecting roller 162 is decreased in a stepwise manner after the base time elapses. According to these configurations, since it is possible to keep an appropriate amount of toner between the conveyance belt 161 and the cleaning roller 162, it is possible to suppress the abnormal noise from being generated when continuously performing the printing operation, further surely.

In the above illustrative embodiments, the cleaning current is applied between the backup roller 165 and the collecting roller 162. However, the present invention is not limited thereto. For example, it may be possible that while first current is applied between the backup roller 165 and the cleaning roller 161, second current (cleaning current) is applied between the backup roller 165 and the collecting roller 162. In this case, the first current may be constant and only the second current may be decreased when the base time elapses after the printing operation starts.

In the above illustrative embodiments, the humidity sensor 191 is provided to detect the humidity in the body casing 102. However, the present invention is not limited thereto. In other words, a known configuration or method may be adopted to detect (estimate) the humidity in the apparatus body. For example, when the transfer roller 143D of the illustrative embodiments includes an ion conductive material, a resistance value is decreased under high humidity environments. Accordingly, it may be possible to control the amount of the current flowing between the cleaning roller and the collecting member by estimating humidity from the resistance value (alternatively, by using the resistance value itself).

In the above illustrative embodiments, when the humidity in the body casing 102 is the predetermined value or smaller, the cleaning current is decreased. However, the present invention is not limited thereto. In other words, irrespective of the humidity in the apparatus body, it may be possible to decrease the current flowing between the cleaning roller and the collecting member when the base time elapses after the printing operation starts.

In the above illustrative embodiments, the color printer 101 is exemplified which exposes the photosensitive members by the laser light. However, the image forming apparatus to which the inventive concept can be applied is not limited thereto. For example, a printer, which is configured to expose the photosensitive members by an exposure head that is provided adjacent to the photosensitive members and has a plurality of tight emitting parts (LED and the like), is also possible. In addition, the image forming apparatus is not limited to the printer and may be a copier or multifunction machine having a document scanner such as flat plate-type scanner.

In the above illustrative embodiments, the 'printing start' is defined as a time when the feeder mechanism 133 picks up the first sheet S. However, the present invention is not limited thereto. For example, the 'printing start' may be defined as a time when a printing job is input, or when the conveyance belt 143C is rotated or when the exposure device 141 starts to emit the laser light.

In the above illustrative embodiments, the 'printing end' is defined as a time when the processes of all printing jobs accumulated (stored) in the color printer 101 are completed. However, the present invention is not limited thereto. For example, the 'printing end' may be defined as a time when the sheet sensor provided on the sheet discharge path 151 detects a last sheet S.

In the above illustrative embodiments, the sheet S such as normal sheet, cardboard and the like is exemplified as a recording sheet. However, the present invention is not limited thereto. For example, an OHP sheet and the like may be used.

What is claimed is:

1. An image forming apparatus comprising:

an image carrier configured to carry a developer image;

a conveyance belt configured to convey a recording sheet via a position opposing the image carrier;

a belt cleaner configured to remove matters adhered to the conveyance belt;

a driving unit configured to drive the image carrier and the conveyance belt;

a bias applying unit configured to apply a cleaning bias to the belt cleaner; and a controller configured to control the driving unit and the bias applying unit such that when the image carrier is driven at a first speed and the conveyance belt is driven at a speed corresponding to the first speed, the cleaning bias is applied to the belt cleaner, and when the image carrier is driven at a second speed slower than the first speed and greater than zero and the conveyance belt is driven at a speed corresponding to the second speed, the cleaning bias is not applied to the belt cleaner.

2. The image forming apparatus according to claim 1, wherein the image forming apparatus has:

a first image forming mode in which the image carrier is driven at the first speed and an image is formed at a first process speed, a second image forming mode in which the image carrier is driven at the second speed and an image is formed at a second process speed, and a cleaning mode in which the matters adhered to the conveyance belt are removed after the first image forming mode and the second image forming mode are completed, and wherein the controller is configured to control the bias applying unit to apply the cleaning bias to the belt cleaner in the first image forming mode and the cleaning mode, and to not apply the belt cleaner in the second image forming mode.

3. The image forming apparatus according to claim 2, wherein the controller is configured to control the driving unit such that, in the cleaning mode, the image carrier is driven at the first speed and the conveyance belt is driven at the speed corresponding to the first speed.

* * * * *